United States Patent [19]

Sugiyama

[11] 4,368,552

[45] Jan. 18, 1983

[54] METHOD OF MAKING SELF TAPPING THREAD FORMING SCREW

[75] Inventor: Ichirou Sugiyama, Shiki, Japan

[73] Assignee: Crown Screw Corporation, Shiki, Japan

[21] Appl. No.: 203,885

[22] Filed: Nov. 4, 1980

[51] Int. Cl.[3] ..... B21K 1/56; B21H 3/02

[52] U.S. Cl. ..... 10/10 R; 10/27 R

[58] Field of Search ..... 10/10 R, 27 R, 141 R, 10/152 R, 152 T; 72/88; 411/411, 416, 417, 418

[56] References Cited

U.S. PATENT DOCUMENTS

| | | | |
|---|---|---|---|
| 3,180,126 | 4/1965 | Carlson | 10/10 R X |
| 3,451,080 | 6/1969 | McIntyre et al. | 10/10 R |
| 3,469,491 | 9/1969 | Munsey | 10/10 R X |
| 3,597,781 | 8/1971 | Eibes | 10/10 R |
| 3,633,455 | 1/1972 | Larson | 10/10 R X |
| 3,878,759 | 4/1975 | Carlson | 10/10 R X |

FOREIGN PATENT DOCUMENTS

| | | | |
|---|---|---|---|
| 1348814 | 2/1963 | France | 10/10 R |
| 54-31757 | 10/1979 | Japan . | |

*Primary Examiner*—Ervin M. Combs

*Attorney, Agent, or Firm*—Wenderoth, Lind & Ponack

[57] ABSTRACT

A method of making a screw for forming internal threads in a hole in a work formed from a blank having a shank portion and a frusto-conical shaft portion. Three flat portions extending parallel with the axis of the blank are formed on the shank. A length of the end portion of the frusto-conical shaft portion is left as right circular. A delta formed region is formed on the head end of each flat portion, and has a peripherally arcular convex surface and tapers to the flat portion. By thread rolling all but the shaft end portion, spoon-like recesses are formed at the crest of the threads passing on the flat portion to form inducing male threads. The depth of the spoon-like recesses sequentially decrease on the delta formed region to produce transient torque increasing characteristics.

7 Claims, 20 Drawing Figures

METHOD OF MAKING SELF TAPPING THREAD FORMING SCREW

BACKGROUND OF THE INVENTION

The present invention relates to a method of making a self-tapping thread-forming screw starting from a blank including a right cylindrical shank portion and a tapered frusto-conical shaft portion at a work entering end of the shank portion.

Conventionally, generally three recesses are formed on the shank portion and the frusto-conical shaft portion, the recesses are also inclined to form generally triangular shape. An example of such a screw is shown in U.S. Pat. No. 3,180,126. Thread forming on the blank shown in the patent is very difficult as conventional thread rolling processes cannot be utilized.

The most relevant self tapping thread forming screw is shown in Japanese Patent Application Publication No. 31757/1979, assigned to the same assignee as is the present invention. The known thread forming screw shown in that publication is shown in FIGS. 1–4 of the present application.

Referring to FIG. 1, a screw blank 1 includes a right cylindrical shank portion 2, a head portion 3 at the rear end of the shank portion 2 having a screw driver engage recess, and a frusto-conical shaft portion at the work entering end of the shank portion 2. Three equiangularly spaced flat portions 5 are formed extending from the tip end of the frusto-conical shaft portion 4 to a portion of the right cylindrical shank portion 2. The flat portions 5 extend parallel with the longitudinal axis of the blank 1. Male threads are formed on the blank 1 by conventional thread rolling process on all surface of the frusto-conical shaft portion 4 and the cylindrical shank portion 2.

As male threads are formed to the tip end, it is difficult to align the axis of the screw with the axis of the hole of the work. The screw tends to incline to the axis of the hole, so that incorrect or incomplete female threads tend to be formed. The result may be lack of sufficient screw retaining force or crack of the work while or after the thread forming process. Effort to maintain correct aligned position of the screw is tedious and disturbs rapid screw forming which is required in e.g. a production assembly line.

Further, as shown in FIG. 3, at the head end 6 of the flat portion 5 a vertical shoulder 7 or stepped portion is formed between the outer periphery of the cylindrical shank portion 2 and the head end 6 of the flat portion 5. As shown in FIG. 4, a deep spoon-like recess 8 is formed by the thread rolling process as each thread passes on the flat portion 5 formed on the shank portion 2. A complete thread 9 is formed on the right cylindrical portion of the shank portion so that while thread forming to the hole of the work a, sudden increase of thread forming torque occurs when the complete thread 9 is engaged with the internal surface of the hole. Thus, smooth operation of thread forming is disturbed and the screw retaining force is not sufficiently strong. Further, as the flat portion 5 and the stepped portion 7 are formed by the cold extrusion process in a metal mould, heavy load must be applied to form the stepped portion 7, resulting in a decrease of service life and early damage of the metal mould.

SUMMARY OF THE INVENTION

Accordingly, the primary object of the present invention is to mitigate the above-mentioned drawbacks and to provide an improved method of making a self tapping thread forming screw which is easily aligned to a hole of the work and produces smooth thread forming torque characteristics resulting in increased screw retaining force.

According to one preferred embodiment of the present invention, the self-tapping thread forming screw is made starting from a blank including a right cylindrical shank portion and a tapered frusto-conical shaft portion at the work entering end of the shank portion. At first, three equiangularly spaced flat portions are formed on the blank extending longitudinally on the blank parallel with the longitudinal axis of the blank from the frusto-conical shaft portion leaving a length of right circular frusto-conical shaft end portion at the work entering end to a portion of said cylindrical shank portion. At the same time, on each head end of the flat portion, a delta formed region is formed. The delta formed region includes a peripherally arcular convex surface tapering to the flat portion. Then, the blank is processed by a thread rolling machine to form male threads on the shank portion and the frusto-conical shaft portion leaving a length of right circular frusto-conical shaft end portion. By the thread rolling a length of spoon-like recess is formed on the crest portion of each thread passing on each delta formed region. The spoon-like recesses have passing on the delta formed region the same width and decreasing depth in the direction toward the head end.

As the screw has a right circular shaft end portion which has no thread formed by the thread rolling process at the work entering end, alignment of the screw in a hole of the work is very easily and correctly performed. Thus, no tendency of inclination and incorrect thread forming occurs, and the screw is suitable for assembly line production.

As the spoon-like recesses formed on the crest portion of threads passing on the delta formed region decrease in depth in the direction toward the head end, a smooth transient increase of thread forming torque from inducing male threads having spoon-like recesses to complete threads on the right cylindrical shank portion can be attained. As the torque gradually increases, smooth thread forming results in increased retaining force. Further, by forming the delta formed region, no stepped portion is necessary in the mould to extrude the flat portions. Thus, service life of the mould increases, and extrusion force is decreased.

BRIEF DESCRIPTION OF THE DRAWINGS

The invention will be described in more detail hereinafter with reference to the accompanying drawing which is given solely by way of example and in which:

FIG. 1 to FIG. 4 show a known thread forming screw, in which:

FIG. 1 is a side view of a blank before threads are rolled,

FIG. 2 is a right end view of the blank shown in FIG. 1,

FIG. 3 is an enlarged side view of the blank shown in FIG. 1 to show flat portion formed on the blank, and FIG. 4 is a partial side view of a screw formed from the blank shown in FIG. 1 to show inducing male threads;

DETAILED DESCRIPTION OF THE PREFERRED EMBODIMENT

Figure 5:
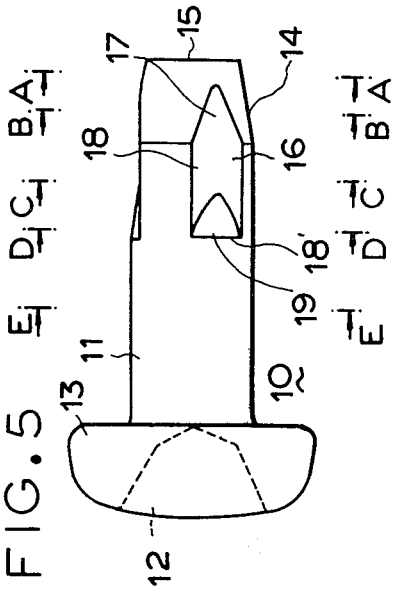
FIG. 5 is a side view of a blank before threads are rolled, according to the present invention.
Figure 6:
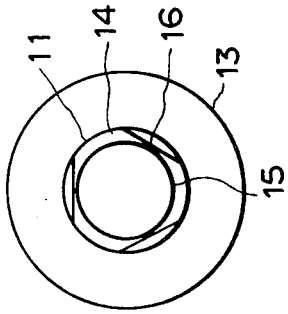
FIG. 6 is a right end view of the blank shown in FIG. 5.

Referring now to FIGS. 5 and 6 of the drawing, there is illustrated a screw blank, generally designated by the numeral 10, which includes a circular cylindrical shank 11, a relatively large head 13 which is formed at one end of the shank 11 and has a driver engage groove 12, and frusto-conical shaft portion 14 which is formed at the other end of the shank 11. The frusto-conical shaft portion 14 includes a frusto-conical shaft end portion 15 which has larger taper angle than the frusto-conical shaft portion and acts as guide to insert in an internal thread forming hold of a work not shown. Three flat portions 16 are formed on the outer surface of the blank 10 equiangularly spaced from each other. Each flat portion is parallel with longitudinal axis of the blank 10 extending from the frusto-conical shaft portion 14 to a portion of the cylindrical shank 11 leaving right circular frusto-conical shaft end portion 15 uneffected.

Figure 2:
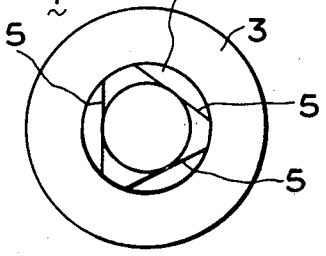
FIG. 2 PRIOR ART
Figure 4:
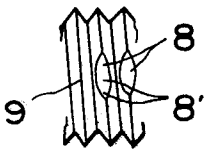
FIG. 4 PRIOR ART
Figure 1:
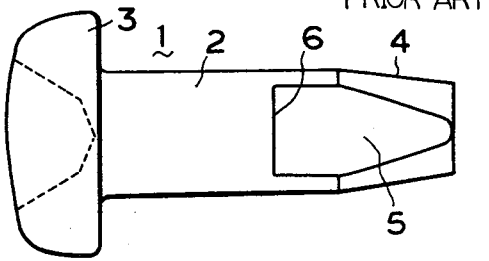
FIG. 1 PRIOR ART
Figure 3:
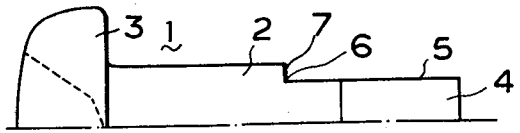
FIG. 3 PRIOR ART

As shown in FIG. 4, by forming the flat portion 16, there is formed a first delta formed region 17 on the frusto-conical shaft portion 11, such that the width of the region 17 increases to the cylindrical shaft portion 11, as the flat portion 16 is parallel with the axis of the blank 10. On the cylindrical shank 11, a rectangular region 18 extends longitudinally from the broadest end of the first delta formed region. The width of the rectangular region 18 is the same as the broadest width of the delta formed region 17. On the head side end of the rectangular region 18, a second delta formed region 19 is formed. The second delta formed region 19 increases in width from tip side to head side (work entering side) of the blank 10 with boundary edges which generally define an isosceles triangle and projects from the rectangular portion 18 as a circular arc in the peripheral section. The projection of the second delta formed region 19 increases to the head side so that a generally smooth transient portion is formed between the recessed rectangular region 18 and the right circular shank 11.

Figure 7A:
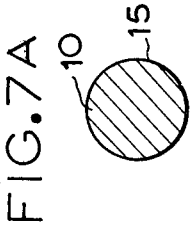
FIGS. 7A-7E are sections along lines A—A, B—B, C—C, D—D and E—E respectively of FIG. 5.
Figure 7B:
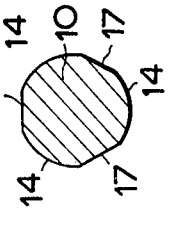
Figure 7E:
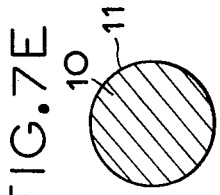
Figure 7D:
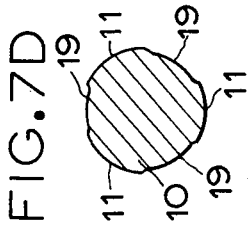
Figure 7C:
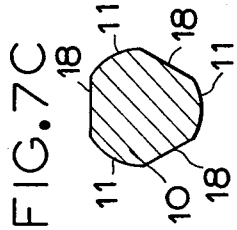
Figure 9:
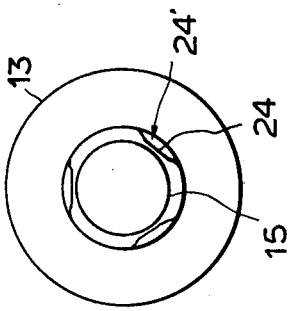
FIG. 9 is a right side end view of the screw shown in FIG. 8.

Sections of the blank 10 thus formed are shown in FIGS. 7A-7E. FIG. 7A shows a section between the first and second frusto-conical shaft portions 14 and 15. As the flat portion 16 does not extend into portion 15, the section is right circular. FIG. 7B shows a section along the first delta formed region 17 on the first frusto-conical shaft portion 14. As the flat portion 16 is shallow and the width of the flat portion 16 is less than in rectangular region 18 of the flat portion 16, the section is nearly a right circular and includes three relative short segments of flat portions 16. FIG. 7C shows a section along the cylindrical shank 11 in the rectangular region 18 of the flat portion 16. Thus, the section includes three relative long flat segments of portions 16 so that the section is generally triangular. FIG. 7D shows a section along the cylindrical shank 11 in the second delta formed portion 19 projected from the flat portion 16. Thus, the section is formed by three large diameter circular arcs which form portions of the periphery of the cylindrical shank 11 and by three small diameter circular arcs which form the second delta formed regions 19, so that the overall shape is generally circular having rather small irregular portions. FIG. 7E shows a section along the cylindrical shank 11 past the flat portions 16, so that the section is right circular without any irregularity.

Figure 8:
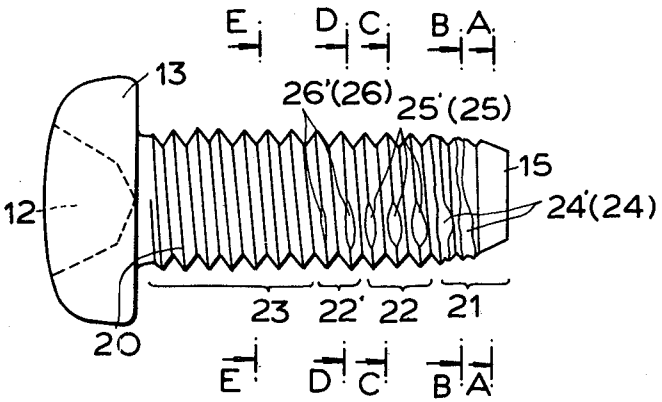
FIG. 8 is a side view of a self-tapping thread forming screw, according to the present invention, after being thread rolled from the blank shown in FIG. 5.

After the blank 10 has been so formed, it is passed into a suitable thread rolling machine, and outside threads 20 are formed on all the cylindrical shank 11 and the frusto-conical shaft portion 14 except the frusto-conical shaft end portion 15 as shown in FIG. 8. By the rolling process, on the frusto-conical shaft portion 14 between the adjacent first delta formed regions 17, first preliminary female thread forming male threads 21 are rolled. On the cylindrical shank 11 between the adjacent rectangular regions 18, second preliminary female thread forming male threads 22 are rolled, and on the cylindrical shank 11 between the adjacent second delta formed regions 13, third preliminary female thread forming male threads 22' are rolled. Normal male threads 23 are formed on the portion of cylindrical shank 11 which is not disturbed by the flat portion 16.

By the thread rolling process, on each first delta formed region 17, first inducing male threads 24 are rolled. The first inducing male threads 24 form spoon-like recesses 24' which increase in depth and length from tip side to head side. On each rectangular region 18, second inducing male threads 25 are rolled. The second inducing male threads 25 form spoon-like recesses 25' each of which have the same depth and the same length. On each second delta formed region 19, third inducing male threads 26 are rolled. The third inducing male threads 26 form spoon-like recesses 26' each of which have the same length and decreasing depth from tip side to head side, as shown in FIG. 8.

FIGS. 10A-10E show sections of the rolled screw shown in FIG. 8. As the lines A—A, B—B, C—C, D—D and E—E correspond in longitudinal positions with the lines shown in FIG. 5, the same letters are used in order to facilitate a comparison of the shapes of the flat portion before and after the thread rolling, by comparing sections of FIG. 7 with corresponding sections of FIG. 10.

Figure 10D:
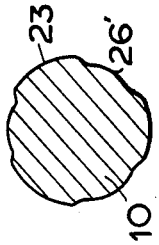
FIGS. 10A-10E are sections along lines A—A, B—B, C—C, D—D and E—E respectively of FIG. 8, corresponding to similar cross sections of the blank shown in FIGS. 7A-7E and along crests of threads.
Figure 10C:
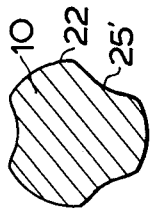
Figure 10B:
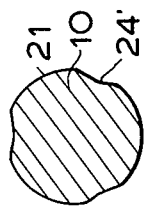
Figure 10A:
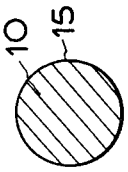
Figure 10E:
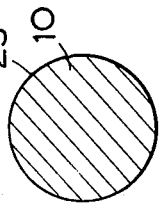

FIG. 10A shows a section between the frusto-conical shaft portion 14 and the frusto-conical shaft end portion 15. As before, the section is right circle, as the flat portion 16 is not extended to the frusto-conical shaft end portion 15. FIG. 10B shows a section along the first delta formed region 17 of the flat portion 16. As shown, relatively shallow spoon-like recesses 24' are formed from the flat portions 17 shown in FIG. 7B. FIG. 10C shows a section along the rectangular portion 18. As shown, relatively deep spoon-like recesses 25' are formed from the straight portion 18 shown in FIG. 7C. FIG. 10D shows a section along the second delta formed regions 19. As shown, outwardly convex spoon-like recesses 26' are formed from the outwardly convex second delta formed regions 19 shown in FIG. 7D. Finally, FIG. 10E shows a section along the straight shank portion, and right circle is shown as FIG. 7E. It will be understood that the sections shown in FIGS. 10A–10E are not straight sections and are shown as sections along crests of threads for the sake of clarity, as the flat portions 16 according to the present invention only affect or deform crests of the threads, and the roots of the threads are not affected.

Figure 12:
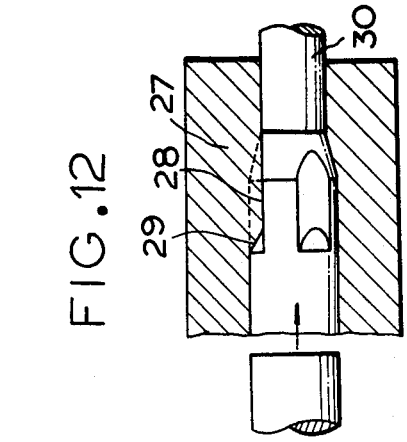
FIG. 12 is a schematic sectional view of an extruding mould to form flat portions of the blank shown in FIG. 5.
Figure 11:
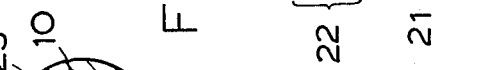
FIG. 11 is an enlarged longitudinal sectional view of a portion of the screw shown in FIG. 8.

Referring to FIG. 12, a cold extruding metal mould 27 extrudes a screw blank to form the flat portion 16 shown in FIG. 5. Three projections 28 are formed in the mould 27. The inlet end of each projection 28 has an edge surface 29 which is concave in peripheral direction and tapers to merge with innermost surface of the projection 28 in generally triangular form. By extruding, the projections 28 form the flat portions 16 which are parallel with longitudinal axis of the blank and including the second delta formed regions 19. A push bar 30 pushes out finished blank 10 from the mould 27. As shown, the projection 28 does not reach the small end portion of the blank 10.

Operation of the thread forming screw shown in FIG. 8 according to the present invention will be described.

At first, the frusto-conical shaft end portion 15 is inserted in a hole in which an internal thread is to be formed internal thread. Suitable material of the work is plastics; however, the thread forming screw can be used to form an internal thread in other material. As the frusto-conical shaft end portion is right circular and free from any thread or flat portion, the screw is easily aligned concentrically with the hole. The maximum diameter of the frusto-conical shaft end portion 15 is less than the inside diameter of the hole of the work. Thus, the thread forming in the hole is begun steadily and easily without any wobbling of the screw.

Then, by rotating the screw by a suitable tool, e.g. a screwdriver engaged with the recess 12 in the head 13, the first inducing male threads 24 which are formed on the frusto-conical shaft portion 14 start thread forming in the hole, and then the second inducing male threads 25 which are formed on a portion of the shank 11 nearly finish thread forming in the hole. The thread forming operation is completed by the third inducing male threads 26 which are formed on the shank 11 and pass on the second delta formed region 19. Thus completed internal threads in the hole engage with complete threads on the shank 11 by further rotation of the screw.

By forming the first, second and third inducing male threads 24, 25 and 26, respectively having spoon-like recesses 24', 25' and 26', the thread forming torque characteristics of the inducing male threads are such that a relatively small torque is required, and smooth thread forming can be performed. Also, by providing the third inducing male threads 26 at the second delta formed region 19, transient thread forming torques between the second inducing male threads 25 and complete threads on the shank are provided by the third inducing male threads 26, so that abrupt change of the torque can be avoided.

As shown in FIGS. 10B–10D, cross sectional forms of the crests of threads on the flat portions 16 are different from each other on the first delta formed region 17, shown in FIG. 10B, on the rectangular region 18 shown in FIG. 10C, and on the second delta formed region 19 shown in FIG. 10D, so that screw retaining force after thread forming in the work is increased. Thus, a screw will not be loosened during use of the work, e.g. by vibration, and the screw is retained screwed in the threaded hole.

By forming the second delta formed region 19 at the end of the flat portion 16 as peripherally convex and triangularly tapered, abrupt changes along the shank 11 are avoided, and the flat portion 16 can be extruded easily in the blank so that service life of the extrusion mould 27 shown in FIG. 12 is remarkably extended without damage or local excess wear. As the second delta formed region 19 is sufficiently long to obtain smooth transient thread forming into complete thread on the shank.

It will be appreciated that the self-tapping thread forming screw, according to the present invention, can be easily aligned with the hole of the work, easily forms thread in the hole with less torque and is retained in the hole with sufficient retaining force. Also, the self tapping thread-forming screw can be operated easily and can be produced easily with less extrusion force.

What is claimed is:

1. A method of making a self-tapping thread-forming headed screw comprising the steps of:

(a) forming a blank having a longitudinal axis, including a generally right-cylinder shank portion and a tapered frusto-conical shaft portion at the work entering end of the shank portion;

(b) forming three spaced flat portions on the blank extending longitudinally on the blank parallel with the longitudinal axis, terminating at opposite ends within the shank portion and the shaft portion;

(c) forming a delta formed region at the head end of each of the flat portions, the delta formed region including a peripherally arcuate convex surface tapering gradually to the flat portion and having side edges such that the side edges and the edge of the delta formed region closest to the screw head, which bound the delta formed region, define an isosceles triangle; and (d) thread rolling the blank to form male threads on the shank portion and the frusto-conical shaft portion except at the work entering end thereof, whereby a second length of spoon-like recesses are formed on the crest portions of the threads passing on each delta formed region, adjacent ones of the spoon-like recesses having a same width and decreasing depth in the direction from the work entering end to head end of the screw.

2. A method as in claim 1, wherein each delta formed region has a length measured longitudinally which is substantially greater than the widths of the male threads passing thereon.

3. A method as in claim 1, wherein the first length of the frusto-conical shaft portion is tapered at an angle with respect to the longitudinal axis which is greater than the angle of taper of the remainder of the frusto-conical shaft portion.

4. A method as in claim 1 or 3, wherein the three spaced flat portions terminate substantially at the head end of the first length of the frusto-conical shaft portion.

5. A method as in claim 1, wherein the three spaced flat portions comprise three equiangularly spaced flat portions.

6. A method of making a self-tapping thread-forming headed screw comprising the steps of:

(a) forming a blank having a longitudinal axis, including a generally right cylinder shank portion and a tapered frusto-conical shaft portion at the work entering end of the shank portion;

(b) forming three spaced flat portions on the blank extending longitudinally on the blank parallel with the longitudinal axis, terminating at opposite ends within the shank portion and the shaft portion;

(c) forming a delta formed region at the head end of each of the flat portions, the delta formed region including a peripherally arcuate convex surface tapering gradually along its length to the flat portion;

(d) thread rolling the blank to form male threads of width substantially less than the length of each of the delta formed regions on the shank portion and the frusto-conical shaft portion except a first length of the frusto-conical shaft portion at the work entering end thereof, whereby a second length of spoon-like recesses are formed on the crest portions of the threads passing on each delta formed region, adjacent ones of the spoon-like recesses having a same width and decreasing depth in the direction from the work entering end to head end of the screw.

7. A method of making a self-tapping thread-forming headed screw comprising the steps of:

(a) forming a blank having a longitudinal axis, including a generally right shank portion and a tapered frusto-conical shaft portion at the work entering end of the shank portion, the frusto-conical shaft portion including a first segment contiguous with the shank portion tapered at a first angle with respect to the longitudinal axis and a second end segment longitudinally spaced from the shank portion and contiguous with the first segment, tapered at a second angle greater than the first angle;

(b) forming three equiangularly spaced flat portions on the blank extending longitudinally on the blank parallel with the longitudinal axis, terminating at opposite ends within the shank portion and substantially at the boundary between the first and second segments of the frusto-conical shaft portion;

(c) forming a delta formed region at the head end of each of the flat portions, the delta formed region including a peripherally arcuate convex surface tapering gradually along its length to the flat portion and having side edges such that the side edges and the edge of the delta formed region closest to the screw head, which bound the delta formed region, define an isosceles triangle; and (d) thread rolling the blank to form male threads of width substantially less than the length of each of the delta formed regions on the shank portion and the frusto-conical shaft portion except the second end segment thereof, whereby a plurality of spoon-like recesses are formed on the crest portions of the threads passing on each delta formed region, adjacent ones of the spoon-like recesses having a same width and decreasing depth in the direction from the work entering end to the head end of the screw.

* * * * *